US006825608B2

(12) United States Patent
Chen

(10) Patent No.: US 6,825,608 B2
(45) Date of Patent: Nov. 30, 2004

(54) FIELD EMISSION DISPLAY DEVICE

(75) Inventor: Ga-Lane Chen, Fremont, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 40 days.

(21) Appl. No.: 10/194,683

(22) Filed: Jul. 12, 2002

(65) Prior Publication Data

US 2004/0007964 A1 Jan. 15, 2004

(51) Int. Cl.[7] ..... H01J 1/62; H01J 1/02
(52) U.S. Cl. ..... 313/495; 313/336; 313/351
(58) Field of Search ..... 313/495–497, 313/346 R, 336, 309, 351, 311, 486, 485, 473

(56) References Cited

U.S. PATENT DOCUMENTS 5,770,919 A * 6/1998 Tjaden et al. ..... 313/495
5,891,321 A * 4/1999 Bernhardt ..... 205/664
5,913,704 A * 6/1999 Spindt et al. ..... 445/24
5,965,898 A * 10/1999 Jones et al. ..... 257/10
5,969,473 A * 10/1999 Huange et al. ..... 313/495
6,031,250 A * 2/2000 Brandes et al. ..... 257/77
6,211,608 B1 * 4/2001 Raina et al. ..... 313/309
6,218,771 B1 * 4/2001 Berishev et al. ..... 313/311
6,646,282 B1 * 11/2003 Chen ..... 257/10

* cited by examiner

*Primary Examiner*—Nimeshkumar D. Patel
*Assistant Examiner*—German Colón
(74) *Attorney, Agent, or Firm*—Wei Te Chung

(57) ABSTRACT

A field emission display device (1) includes a cathode plate (20), a resistive buffer (30) in contact with the cathode plate, a plurality of electron emitters (40) formed on the buffer, and an anode plate (50) spaced from the electron emitters. Each electron emitter includes a nano-rod first part (401) and a conical second part (402). The buffer and the nano-rods are made from silicon carbide ($SiC_X$). The combined buffer and nano-rods has a gradient distribution of electrical resistivity such that highest electrical resistivity is nearest the cathode plate and lowest electrical resistivity is nearest-the anode plate. The conical parts are made from molybdenum. When emitting voltage is applied between the cathode and anode plates, electrons emitted from the electron emitters traverse the interspace region and are received by the anode plate. Because of the gradient distribution of electrical resistivity, only a very low emitting voltage is needed.

17 Claims, 1 Drawing Sheet

FIELD EMISSION DISPLAY DEVICE

BACKGROUND OF THE INVENTION

1. Field of the Invention

The present invention relates to a field emission display (FED) device, and more particularly to an FED device using nano-scale electron emitters having low emitting voltage and excellent mechanical properties.

2. Description of Related Art

In a conventional FED device, electrons are extracted from emitters on a cathode by applying an emitting voltage to tips of the emitters. The emitters are made of metals such as molybdenum, or semiconductive materials such as silicon. The electrons impinge on phosphors on the back of a transparent cover plate and thereby produce an image.

One major problem of the conventional FED device is that the work functions of metals or semiconductive materials used for the emitters are large. That is, the emitting voltage required for electron emission is very high. Another major problem is the poor mechanical properties of the emitters. When residual gas particles in a vacuum within the FED device collide with electrons, the gas particles become ionized. The emitters are bombarded with these gas ions, and some of the emitters are degraded to the point where they can no longer function as an electron emission source. These problems reduce the performance and lifetime of the emitters. To overcome these problems, a new kind of emitter having a low work function and excellent mechanical properties is needed for an FED device to provide better performance and longer lifetime.

Moreover, in a typical FED device, most of electrons are extracted from the emitters, but there are still a certain amount of electrons extracted from the outermost layer of the cathode when an electrical field is applied. The electrons extracted from the outermost layer of the cathode cause non-uniform electron emission, and therefore non-uniform brightness at the phosphors. To overcome this problem, new means are needed for the FED device to achieve uniform electron emission.

SUMMARY OF THE INVENTION

In view of the above-described problems of the related art, an object of the present invention is to provide a field emission display (FED) device with nano-scale electron emitters having low emitting voltage and excellent mechanical properties.

Another object of the present invention is to provide an FED device which has accurate and reliable electron emission.

In order to achieve the objects set above, an FED device in accordance with a preferred embodiment of the present invention comprises a cathode plate, a resistive buffer in contact with the cathode plate, a plurality of electron emitters formed on the resistive buffer, and an anode plate spaced from the electron emitters thereby defining an interspace region therebetween. Each of the electron emitters comprise a nano-rod first part formed on the buffer, and a conical second part formed on a free end of respective nano-rod. The buffer and the nano-rods are made from silicon carbide; namely ($SiC_X$), in which x can be controlled according to the required stoichiometry. The combined buffer and nano-rods has a gradient distribution of electrical resistivity such that highest electrical resistivity is nearest the cathode plate and lowest electrical resistivity is nearest the anode plate. The conical parts are made from molybdenum. When emitting voltage is applied between the cathode and anode plates, electrons emitted from the electron emitters traverse the interspace region and are received by the anode plate. Because of the gradient distribution of electrical resistivity, only a very low emitting voltage is needed.

In an alternative embodiment the combined buffer and nano-rods can incorporate more than one gradient distribution of electrical resistivity.

Other objects, advantages and novel features of the present invention will become more apparent from the following detailed description when taken in conjunction with the accompanying drawing, in which:

DETAILED DESCRIPTION OF PREFERRED EMBODIMENTS OF THE INVENTION

Figure 1:
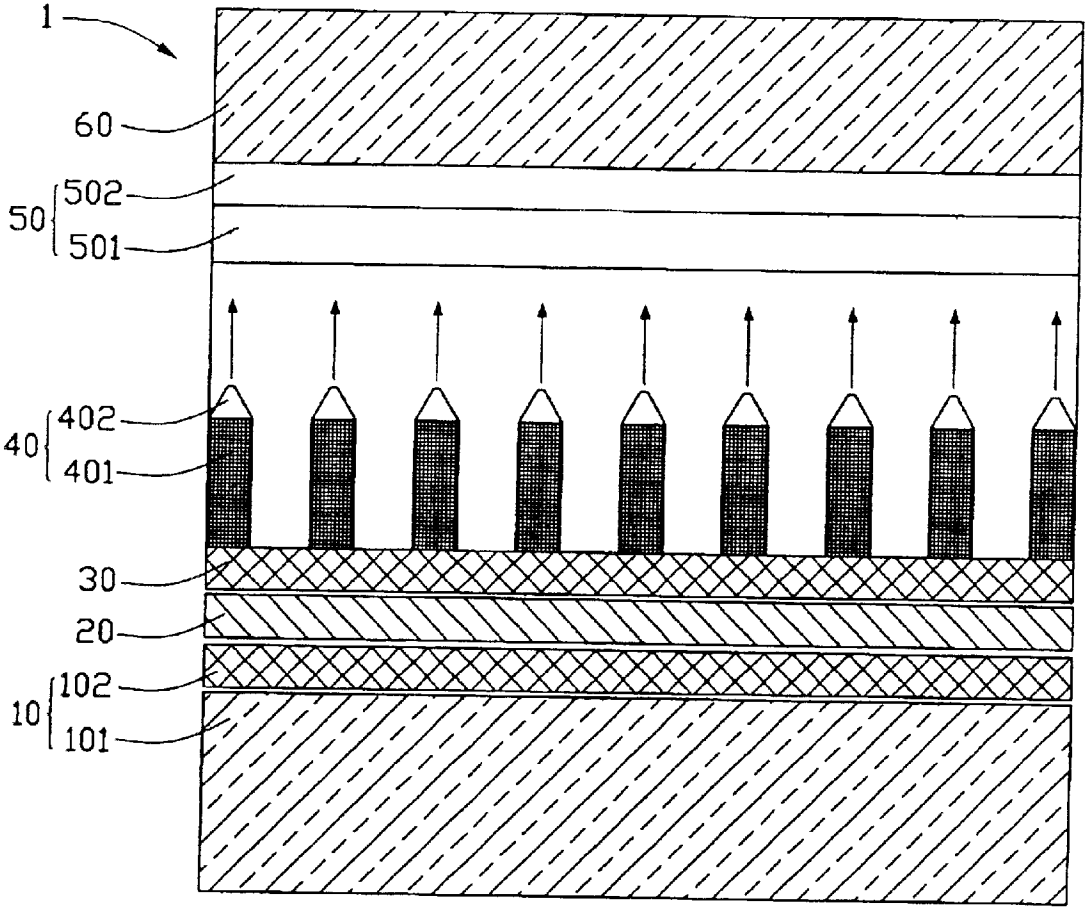
FIG. 1 is a schematic, cross-sectional view of a field emission display (FED) device in accordance with a preferred embodiment of the present invention.

Referring to FIG. 1, a field emission display device 1 in accordance with a preferred embodiment of the present invention comprises a first substrate 10, a cathode plate 20 made from electrically conductive material formed on the first substrate 10, a resistive buffer 30 in contact with the cathode plate 20, a plurality of electron emitters 40 formed on the resistive buffer 30, an anode plate 50 spaced from the electron emitters 40 thereby defining an interspace (not labeled) region between the electron emitters 40 and the anode plate 50, and a second substrate 60.

The first substrate 10 comprises a glass plate 101 and a silicon thin film 102. The silicon thin film 102 is formed on the glass plate 101 for providing effective contact between the glass plate 101 and the cathode plate 20.

Each of the electron emitters 40 comprises a nano-rod first part 401 formed on the buffer 30 and a conical second part 402 formed on a free end of respective nano-rod 401. The buffer 30 and the nano-rods 401 are made from silicon carbide; namely ($SiC_X$), in which x can be controlled according to the required stoichiometry. In the preferred embodiment, x is controlled to ensure that the combined buffer 30 and nano-rods 401 has a gradient distribution of electrical resistivity such that highest electrical resistivity is nearest the cathode plate 20 and lowest electrical resistivity is nearest the anode plate 50. In the preferred embodiment, the conical parts 402 are made from molybdenum (Mo).

In the preferred embodiment, each nano-rod 401 has a microstructure with a diameter in the range from 5 to 50 nanometers and a length in the range from 0.2 to 2.0 micrometers. Each conical part 402 has a microstructure comprising a circular top face (not labeled) at a distal end thereof. A diameter of the top face is in the range from 0.3 to 2.0 nanometers. In the preferred embodiment, the buffer 30 and the electron emitters 40 are preformed together by chemical vapor deposition (CVD), plasma-enhanced chemical vapor deposition (PECVD), or by other suitable chemical-physical deposition methods such as reactive sputtering, ion-beam sputtering, dual ion beam sputtering, and other suitable glow discharge methods. The nano-rods 401 and conical parts 402 can then be formed by e-beam etching or other suitable methods.

In an alternative embodiment of the present invention, the combined buffer 30 and nano-rods 401 can incorporate more than one gradient distribution of electrical resistivity.

The anode plate 50 is formed on the second substrate 60, and comprises a transparent electrode 502 coated with a phosphor layer 501. The transparent electrode 502 allows light to pass therethrough. The transparent electrode 502 may comprise, for example, indium tin oxide (ITO). The phosphor layer 501 luminesces upon receiving electrons emitted by the conical parts 402 of the electron emitters 40. The second substrate 60 is preferably made from glass.

In operation of the FED device 1, an emitting voltage is applied between the cathode plate 20 and the anode plate 50. This causes electrons to emit from the conical parts 402 of the electron emitters 40. The electrons traverse the interspace region from the conical parts 402 of the electron emitters 40 to the anode plate 50, and are received by phosphor layer 501. The phosphor layer 501 luminesces, and a display is thus produced.

Because the combined buffer 30 and the nano-rods 401 has a gradient distribution of electrical resistivity, only a low emitting voltage needs to be applied between the cathode plate 20 and the anode plate 50 to cause electrons to emit from the conical parts 402.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A field emission display device comprising:

a cathode plate;

a resistive buffer in contact with the cathode plate;

a plurality of electron emitters formed on the resistive buffer, each of the electron emitters comprising a nano-rod first part formed on the resistive buffer; and an anode plate spaced from the electron emitters thereby defining an interspace region therebetween;

wherein the resistive buffer and first parts of the electron emitters are made of silicon carbide, and the combined resistive buffer and the first parts of the electron emitters comprises at least one gradient distribution of electrical resistivity such that highest electrical resistivity is nearest the cathode plate and lowest electrical resistivity is nearest the anode plate.

2. The field emission display device as described in claim 1, wherein each of the nano-rods has a diameter in the range from 5 to 50 nanometers.

3. The field emission display device as described in claim 2, wherein each of the nano-rods has a length in the range from 0.2 to 2.0 micrometers.

4. The field emission display device as described in claim 1, wherein each of the electron emitters further comprises a conical second part formed on a free end of a respective nano-rod, and the conical second parts are made from molybdenum.

5. The field emission display device as described in claim 4, wherein the conical part has a microstructure comprising a circular top face at a distal end thereof, and a diameter of the top face is in the range from 0.3 to 2.0 nanometers.

6. The field emission display device as described in claim 1, wherein the anode plate comprises a transparent electrode coated with phosphor.

7. The field emission display device as described in claim 6, wherein the transparent electrode comprises indium tin oxide.

8. The field emission display device as described in claim 1, wherein the cathode plate is formed on a first substrate comprising glass, and the anode plate is formed on a second substrate comprising glass.

9. The field emission display device as described in claim 8, wherein the first substrate further comprises a silicon thin film formed thereon for providing effective contact between the first substrate and the cathode plate.

10. A field emission display device comprising:

a cathode plate;

a resistive buffer in contact with the cathode plate;

a plurality of electron emitters formed on the resistive buffer, each of the electron emitters comprising a nano-rod first part formed on the resistive buffer and a conical second part formed on a free end of a respective nano-rod; and an anode plate spaced from the electron emitters thereby defining an interspace region therebetween;

wherein the resistive buffer and first parts of the electron emitters are made of silicon carbide, and the resistive buffer comprises at least one gradient distribution of electrical resistivity such that highest electrical resistivity is nearest the cathode plate and lowest electrical resistivity is nearest the anode plate.

11. The field emission display device as described in claim 10, wherein each of the nano-rods has a diameter in the range from 5 to 50 nanometers.

12. The field emission display device as described in claim 11, wherein each of the nano-rods has a length in the range from 0.2 to 2.0 micrometers.

13. The field emission display device as described in claim 10, wherein each of the conical parts has $a_{13}$ microstructure comprising a circular top face at a distal end thereof, and a diameter of the top face is in the range from 0.3 to 2.0 nanometers.

14. A field emission display device comprising:

a cathode plate;

an anode plate spaced from the cathode plate; and a plurality of electron emitters positioned between the cathode plate and the anode plate, each of the electron emitters being a nano-tube comprising a rod-like first part proximate the cathode plate, and a conical second part made of molybdenum adjoining the first part while spaced from the anode plate;

wherein the first part is made of silicon carbide and comprises at least one gradient distribution of electrical resistivity such that highest electrical resistivity is nearest the cathode plate and lowest electrical resistivity is nearest the anode plate.

15. The field emission display device as described in claim 14, wherein said emitters are equally spaced from one another in a direction perpendicular to an extension direction of said emitters.

16. The field emission display device as described in claim 15, wherein no other structures are located between every adjacent two emitters.

17. The field emission display device as described in claim 14, wherein a buffer is in contact with the cathode plate, said emitters extend from said buffer, and said buffer is made of silicon carbide.

* * * * *